US008096155B2

(12) United States Patent
Williams

(10) Patent No.: US 8,096,155 B2
(45) Date of Patent: Jan. 17, 2012

(54) VARIABLE SHEAR LINE LOCK CYLINDER

(75) Inventor: Alston E. Williams, Irvine, CA (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 11/456,733

(22) Filed: Jul. 11, 2006

(65) Prior Publication Data

US 2006/0260371 A1 Nov. 23, 2006

Related U.S. Application Data

(62) Division of application No. 10/815,279, filed on Apr. 1, 2004, now Pat. No. 7,162,901.

(51) Int. Cl.
*E05B 27/04* (2006.01)

(52) U.S. Cl. ..... 70/493; 70/358; 70/383; 70/384

(58) Field of Classification Search ..... 70/358, 70/359, 382–385, 337–343, 376, 378, 392, 70/491–496, DIG. 2, DIG. 22, DIG. 23, DIG. 37, 70/DIG. 71, DIG. 74, DIG. 75, 375
See application file for complete search history.

(56) References Cited

U.S. PATENT DOCUMENTS 1,417,132 A * 5/1922 Barker ..... 70/493
1,958,603 A * 5/1934 Bacon ..... 70/421
1,977,189 A * 10/1934 Larson et al. ..... 70/421
2,158,501 A * 5/1939 Gutman ..... 70/493
2,194,469 A * 3/1940 Fremon ..... 70/493
2,247,621 A * 7/1941 Speer ..... 70/493
2,252,966 A * 8/1941 Fogelson ..... 70/493
3,059,462 A * 10/1962 Check ..... 70/384
3,194,034 A * 7/1965 Leiser ..... 70/358
3,320,781 A * 5/1967 Hill ..... 70/384
3,589,153 A * 6/1971 Hill ..... 70/384
3,595,043 A * 7/1971 Williams ..... 70/273
3,667,262 A * 6/1972 Hill ..... 70/384
3,885,409 A * 5/1975 Genakis ..... 70/493
4,068,509 A * 1/1978 Genakis ..... 70/493
4,142,389 A * 3/1979 Bahry et al. ..... 70/359
4,282,731 A * 8/1981 Taksony ..... 70/493
4,372,139 A * 2/1983 Laake ..... 70/383
4,403,486 A * 9/1983 Miyake ..... 70/383
4,732,023 A * 3/1988 Shen ..... 70/383
5,123,268 A * 6/1992 Eizen ..... 70/359
5,177,466 A * 1/1993 Lai ..... 340/542
5,211,044 A * 5/1993 Kim ..... 70/371
5,233,850 A * 8/1993 Schroeder ..... 70/337
5,325,690 A * 7/1994 Adler et al. ..... 70/383
5,431,034 A * 7/1995 Fann et al. ..... 70/369
(Continued)

*Primary Examiner* — Lloyd Gall
(74) *Attorney, Agent, or Firm* — Richard J. Veltman; John D. DelPonti

(57) ABSTRACT

A lock cylinder is provided and includes an outer cylinder having a bore, an inner cylinder rotatably disposed within the bore, and a pin assembly disposed within the inner and outer cylinders. The pin assembly is operable to selectively lock the inner cylinder relative to the outer cylinder. The pin assembly includes an upper shear cylinder positionable relative to the outer cylinder and a lower shear cylinder positionable relative to the inner cylinder. The upper and lower shear cylinders are movable to define a first shear line therebetween. In addition, the pin assembly includes an upper pin slidable within the upper shear cylinder and a lower pin slidable within the lower shear cylinder, whereby the upper and lower pins define a second shear line therebetween. The lock cylinder is positionable from a locked position to an unlocked position when the first shear line is aligned with the second shear line.

26 Claims, 10 Drawing Sheets

U.S. PATENT DOCUMENTS 5,682,779 A * 11/1997 Dolev ..... 70/494
5,839,308 A * 11/1998 Eizen et al. ..... 70/358
5,931,036 A * 8/1999 Keller ..... 70/495
5,934,119 A * 8/1999 Keller ..... 70/276
5,964,112 A * 10/1999 Stefanescu ..... 70/493
5,966,971 A * 10/1999 Keller ..... 70/359
6,119,495 A * 9/2000 Loreti ..... 70/340
6,257,031 B1 * 7/2001 Misner ..... 70/252
6,776,017 B2 * 8/2004 Herdman ..... 70/338
6,860,131 B2 * 3/2005 Armstrong et al. ..... 70/492
6,862,909 B2 * 3/2005 Armstrong et al. ..... 70/492
7,086,259 B2 * 8/2006 Almoznino ..... 70/359
7,162,901 B2 * 1/2007 Williams ..... 70/493
2003/0140668 A1 * 7/2003 Chao ..... 70/359
2005/0204788 A1 * 9/2005 Almoznino ..... 70/359

* cited by examiner

VARIABLE SHEAR LINE LOCK CYLINDER

FIELD OF THE INVENTION

The present application is a divisional application of Application Ser. No. 10/815,279 for VARIABLE SHEAR LINE LOCK CYLINDER filed Apr. 1, 2004 by Alston E. Williams, now U.S. Pat. No. 7,162,901.

BACKGROUND OF THE INVENTION

It is well known in the art to provide a door hardware assembly that is operable to maintain a door in a closed position by selectively securing the door to a doorframe. It is equally well known to provide a door hardware assembly that is capable of being locked to selectively prevent operation of the door hardware assembly. As can be appreciated, by preventing operation of the door hardware assembly, the door will remain closed and in a locked condition. Such conventional door hardware assemblies generally include a handle assembly, lock cylinder, and key, whereby the key is operable to selectively lock the lock cylinder to prevent operation of the door handle assembly and maintain the door in the closed and locked condition.

Conventional door hardware assemblies are typically disposed on a door proximate to an edge of the door for selective engagement with a striker assembly mounted on a door frame. As previously discussed, door hardware assemblies commonly include a handle assembly, lock cylinder, and key. The lock cylinder is designed to matingly receive a key, whereby the key is operable to toggle the lock cylinder between a locked and unlocked condition. The unlocked condition of the lock cylinder permits rotation of the handle assembly and, thus, movement of the door relative the doorframe. The locked condition prohibits rotation of the handle assembly, thereby maintaining the door in a closed and locked condition. As can be appreciated, the key is specific to the particular lock cylinder so as to prevent unwanted operation of the door handle assembly and movement of the door relative the doorframe. In this regard, a lost or stolen key may provide unwanted operation of the lock cylinder and unwanted access through the door. For at least this reason, being able to "reset" or "re-key" the lock cylinder, without having to replace the entire mechanism, is a desirable feature. In this regard, conventional door hardware assemblies commonly provide for adjustment of a locking mechanism disposed within the lock cylinder.

Re-keying of a conventional lock cylinder provides the lock cylinder with a new key that is operable to lock and unlock the re-configured lock cylinder, while concurrently prohibiting further use of the lost key. Such lock cylinders commonly include a plurality of pin assemblies, whereby each pin assembly includes an upper pin slidably disposed within an upper shear cylinder and a lower pin slidably disposed within a lower shear cylinder. The upper and lower shear cylinders are axially aligned such that a first shear zone is formed between the upper and lower pins and a second shear zone is formed between the upper and lower shear cylinders. As previously discussed, a key is used to selectively lock and unlock the lock cylinder, whereby raised portions disposed on the key are operable to engage the upper and lower pins to properly align the second shear zone with the first shear zone. Proper alignment of the first and second shear zones allows each pin to disengage the respective shear cylinder and permit rotation of the door handle assembly.

In a re-keying operation, the upper and lower pins are adjusted to vary the relative heights of each of the upper and lower pins. In this regard, a new key having raised portions commensurate with the new pin heights of each pin assembly, is required to properly align the first and second shear zones of the upper and lower pins. Once the new pins are installed, the lock cylinder will no longer permit rotation of the door handle assembly if the old key is used in the lock cylinder. As can be appreciated, the old key is not commensurate with the new pin heights and therefore will not properly align the first and second shear zones of the respective pin assemblies.

While conventional lock cylinders adequately provide for a re-keying operation of a lock cylinder, they suffer from the disadvantage of requiring partial disassembly of the lock cylinder and typically require a specialized technician, such as a locksmith, to perform the re-keying operation. Further, conventional lock cylinders suffer from the disadvantage of requiring various pin heights and combinations thereof to properly re-key the cylinder. Further yet, conventional re-keying kits require door hardware manufacturers to produce varying pin heights for each kit, thereby overproducing the required number of individual pins to simply re-key one lock cylinder.

Therefore, a lock cylinder that provides for a re-keying operation without requiring disassembly of the lock cylinder is desirable in the industry. Furthermore, a lock cylinder that is capable of being re-keyed without replacing the existing components is also desirable. Further yet, a lock cylinder that provides for a re-keying operation without requiring a plurality of additional pins with varying pin heights is also desirable.

SUMMARY OF THE INVENTION

Accordingly, the present invention provides a lock cylinder including an outer cylinder having a first bore formed along a first longitudinal axis, an inner cylinder rotatably disposed within the first bore along a shear zone, and a pin assembly disposed within the inner and outer cylinders. The pin assembly is operable to selectively lock the inner cylinder relative to the outer cylinder. The pin assembly includes an upper shear cylinder positionable relative to the outer cylinder and a lower shear cylinder positionable relative to the inner cylinder, whereby the upper and lower shear cylinders are movable to define a first shear line therebetween. In addition, the pin assembly includes an upper pin slidable within the upper shear cylinder and a lower pin slidable within the lower shear cylinder, whereby the upper and lower pins define a second shear line therebetween. The lock cylinder is positionable from a locked position to an unlocked position when the first shear line is aligned with the second shear line.

In addition, upper and lower lock racks are provided to lock the upper and lower shear cylinders relative to the inner and outer cylinders. Specifically, the upper lock rack is operable to lock the upper shear cylinder relative to the outer cylinder while the lower lock rack is operable to lock the lower shear cylinder relative to the inner cylinder. In this regard, the upper and lower lock racks are operable to position the first shear line in one of a plurality of positions relative to the inner and outer cylinders to vary the position of the first shear line during a re-keying operation.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
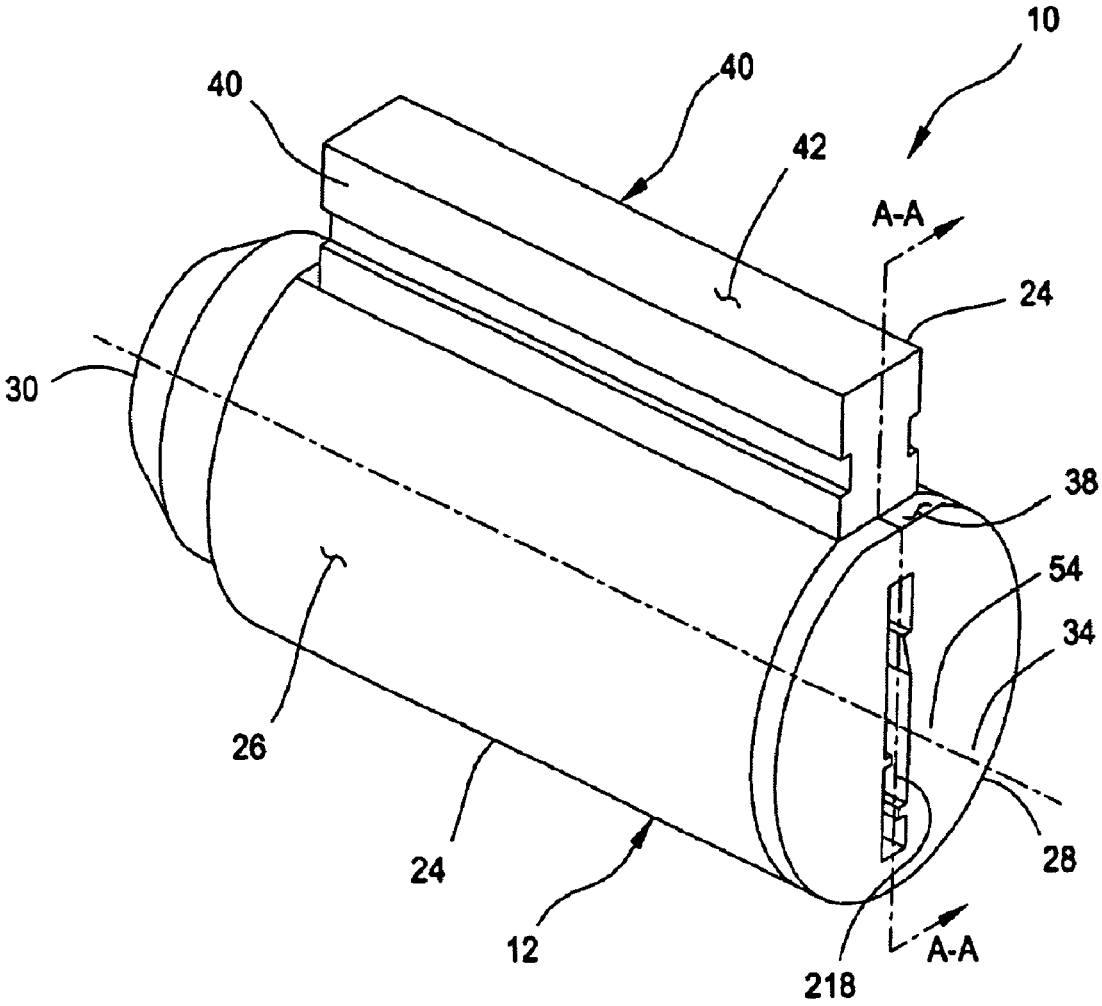
FIG. 1 is a perspective view of a lock cylinder in accordance with the principals of the present invention.

The following description of the preferred embodiment(s) is merely exemplary in nature and is in no way intended to limit the invention, its application, or uses.

With reference to the figures, a variable shear line lock cylinder 10 is provided and includes an outer cylinder 12, an inner cylinder 14, a plurality of pin assemblies 16, a lock assembly 18, and actuation mechanism 20. The outer cylinder 12 rotatably receives the inner cylinder 14 while the pin assemblies 16 are disposed therebetween. The pin assemblies 16 are operable to selectively prevent rotation of the inner cylinder 14 relative to the outer cylinder 12 and are positionable relative to the inner and outer cylinders 14, 12 through engagement with the lock assembly 18. In addition, the actuation mechanism 20 interacts with the pin assemblies 16 and is operable to allow rotation of the inner cylinder 14 relative to the outer cylinder 12, as will be discussed further below.

Figure 2:
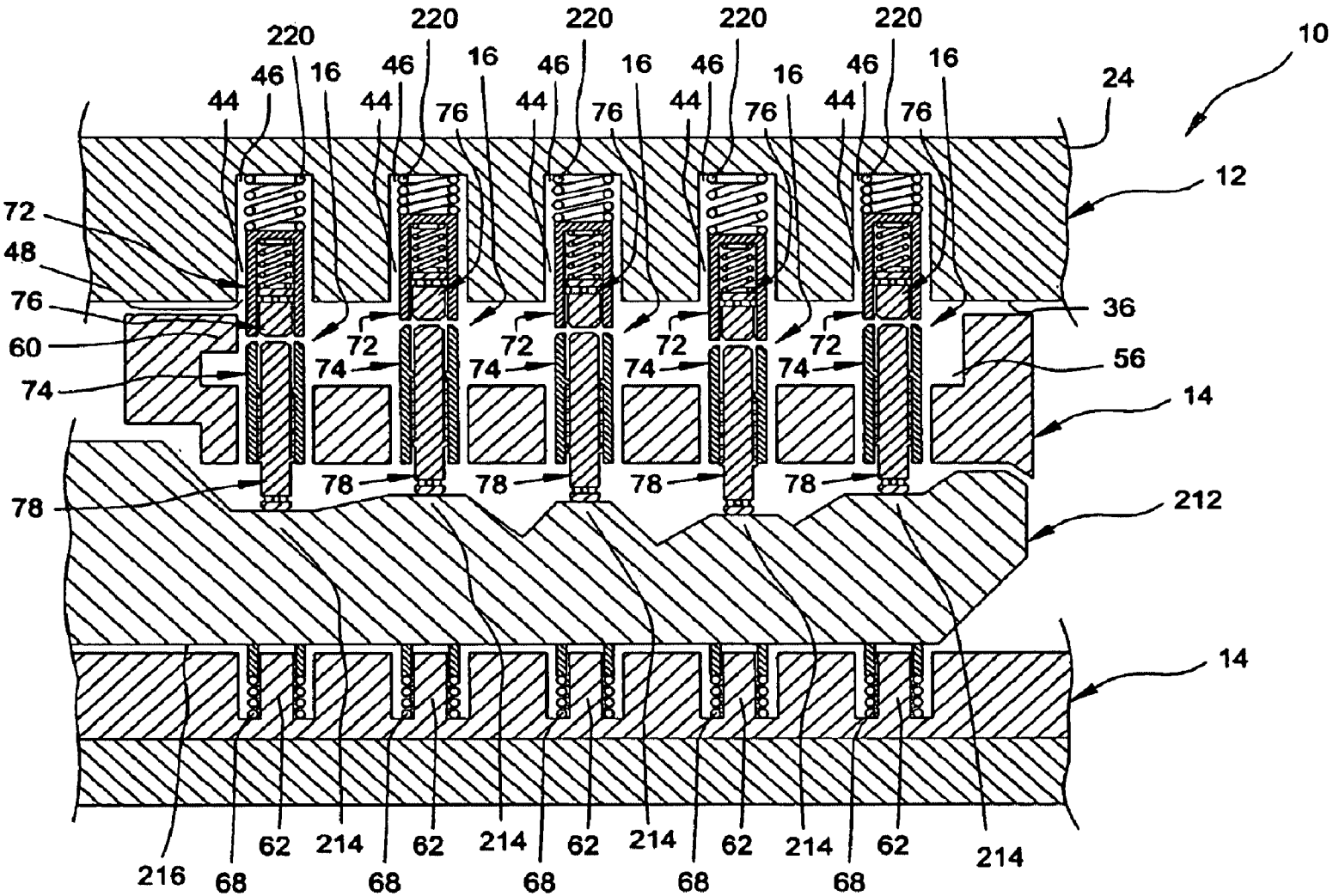
FIG. 2 is a sectional view of the lock cylinder of FIG. 1 taken along the line A-A.

The outer cylinder 12 includes a main body 22 formed integrally with a stack 24, as best shown in FIG. 1. The main body 22 has a generally cylindrical shape having an arcuate outer surface 26 extending between first and second ends 28, 30, and further includes a bore 32 extending along a longitudinal axis 34. The bore 32 forms an inner surface 36 of the main body 22 and is operable to rotatably receive the inner cylinder 14, as best shown in FIG. 2.

The stack 24 is disposed on a generally planar surface 38 of the main body 22 and includes two planar sidewalls 40 and a top surface 42. A plurality of bores 44 extend between the stack 24 and main body 22 such that each bore 44 includes a closed end 46 proximate the top surface 42 and an open end 48 proximate the main body 22 and open to the bore 32, as best shown in FIG. 2. Specifically, the open ends 48 extend into bore 32 of the main body 22 and are each operable to receive a pin assembly 16, as will be discussed further below.

Figure 3:
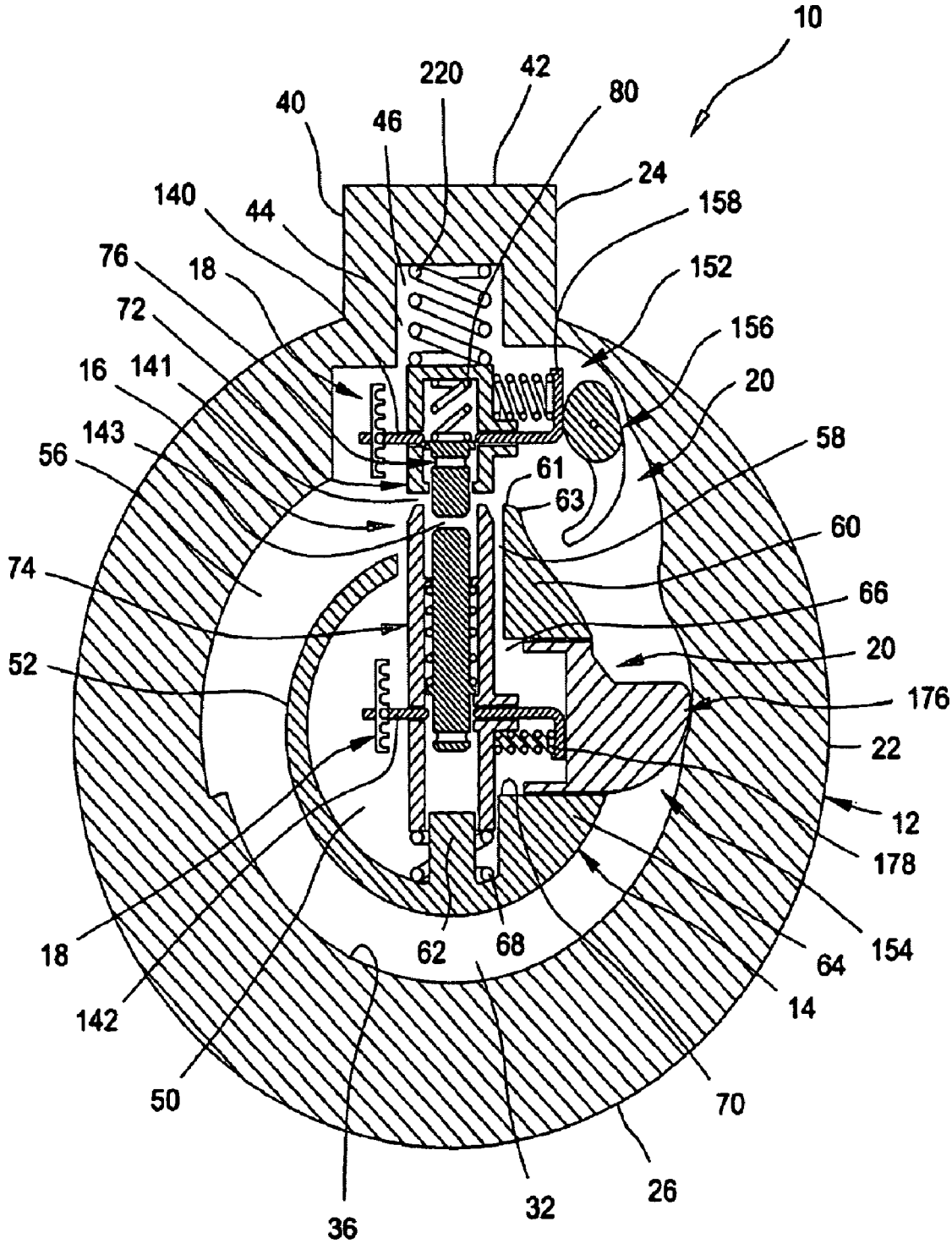
FIG. 3 is a sectional view of the lock cylinder of FIGS. 1 and 2 in a locked position.

The inner cylinder 14 is rotatably received by the bore 32 of the outer cylinder 12 and includes a central bore 50, an arcuate outer surface 52, and an axis of rotation 54. The axis of rotation 54 of the inner cylinder 14 is formed generally coaxially with the longitudinal axis 34 of the outer cylinder 12, such that the inner cylinder 14 is received generally at a central point of the bore 32. In this manner, a recess 56 is formed between the outer surface 52 of the inner cylinder 14 and the inner surface 36 of the outer cylinder 12, as best shown in FIG. 3.

The inner cylinder 14 further includes a plurality of pin bores 58, a shoulder 60, a spring seat 62, and a shelf portion 64 formed by a bore 66. The pin bores 58 extend from the outer surface 52 of the inner cylinder 14 and terminate at the central bore 50. Each pin bore 58 is aligned with a respective bore 44 of the stack 24 for receiving a pin assembly 16 therebetween. The shoulder 60 is disposed on the outer surface 52 of the inner cylinder 14, proximate the pin bores 58, and includes a cam surface 61 having an engagement face 63.

The spring seat 62 is a generally cylindrical member extending into the central bore 50 of the inner cylinder 14 and receives a lower spring 68. The bore 66 extends into the central bore 50, and further serves to form the shelf 64, as best shown in FIG. 3. The shelf 64 extends the length of the bore 66 and includes a reaction surface 70 for interaction with the pin assembly 16.

As previously discussed, the lock cylinder 10 includes a plurality of pin assemblies 16. Each pin assembly 16 includes an upper shear cylinder 72, a lower shear cylinder 74, an upper pin 76, a lower pin 78, and an upper spring 80. As each pin assembly 16 is virtually identical, a detailed description of each individual assembly is foregone.

Figure 4:
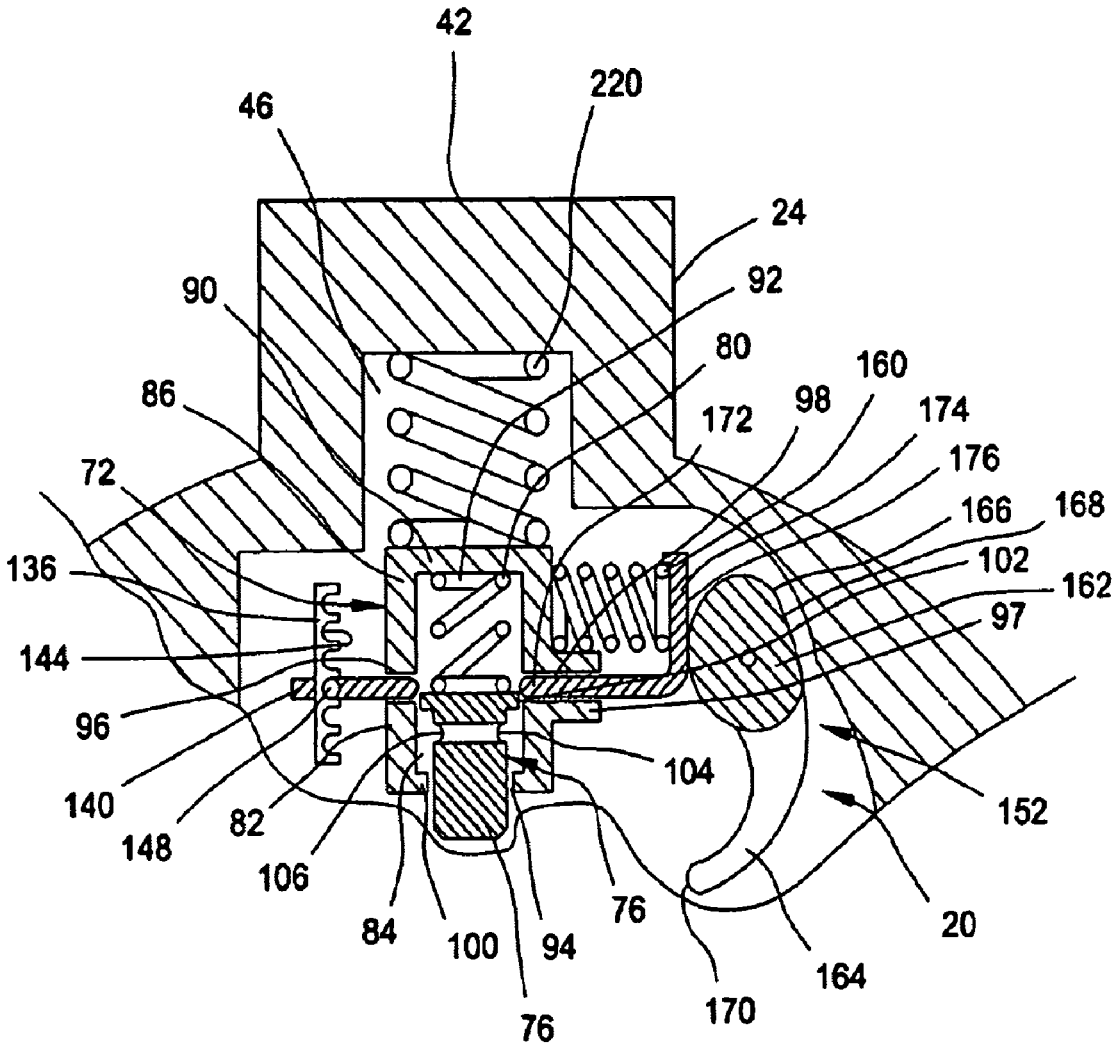
FIG. 4 is a more detailed cross-sectional view of particular components of FIG. 3.

The upper shear cylinder 72 includes an outer diameter having a generally cylindrical shape and an arcuate surface 82. The upper shear cylinder 72 further includes a bore 84, a wall 86, and an end cap 90. The bore 84 extends from a closed end 92 to an open end 94, whereby the open end 94 is disposed proximate the recess 56, as best shown in FIG. 3. The wall 86 includes a lock bore 96 for interaction with the lock assembly 18 and an actuation bore 98 for interaction with the actuation assembly 20, as will be discussed further below. The actuation bore 98 further includes a support collar 97 integrally formed with the upper shear cylinder 72 to reinforce the junction between the actuation bore 98 and the wall 86. In addition, the wall 86 includes an annular tab 100 formed on an inner surface of the wall 86, disposed proximate the open end 94, for interaction with the upper and lower pins 76, 78, as best shown in FIG. 4.

The upper pin 76 is slidably received by the bore 84 of the upper shear cylinder 72 and includes an annular shoulder 102 and an annular groove 104. In addition, the upper pin 76 includes an engagement bore 106 formed through the upper pin 76, whereby the engagement bore 106 is operable to align with both the lock bore 96 and the actuation bore 98, as will be discussed further below. The upper spring 80 is disposed between the shoulder 102 and the closed end 92 of the upper shear cylinder 72 and is operable to bias the upper pin 76 toward the open end 94 of the upper shear cylinder 72.

Figure 5:
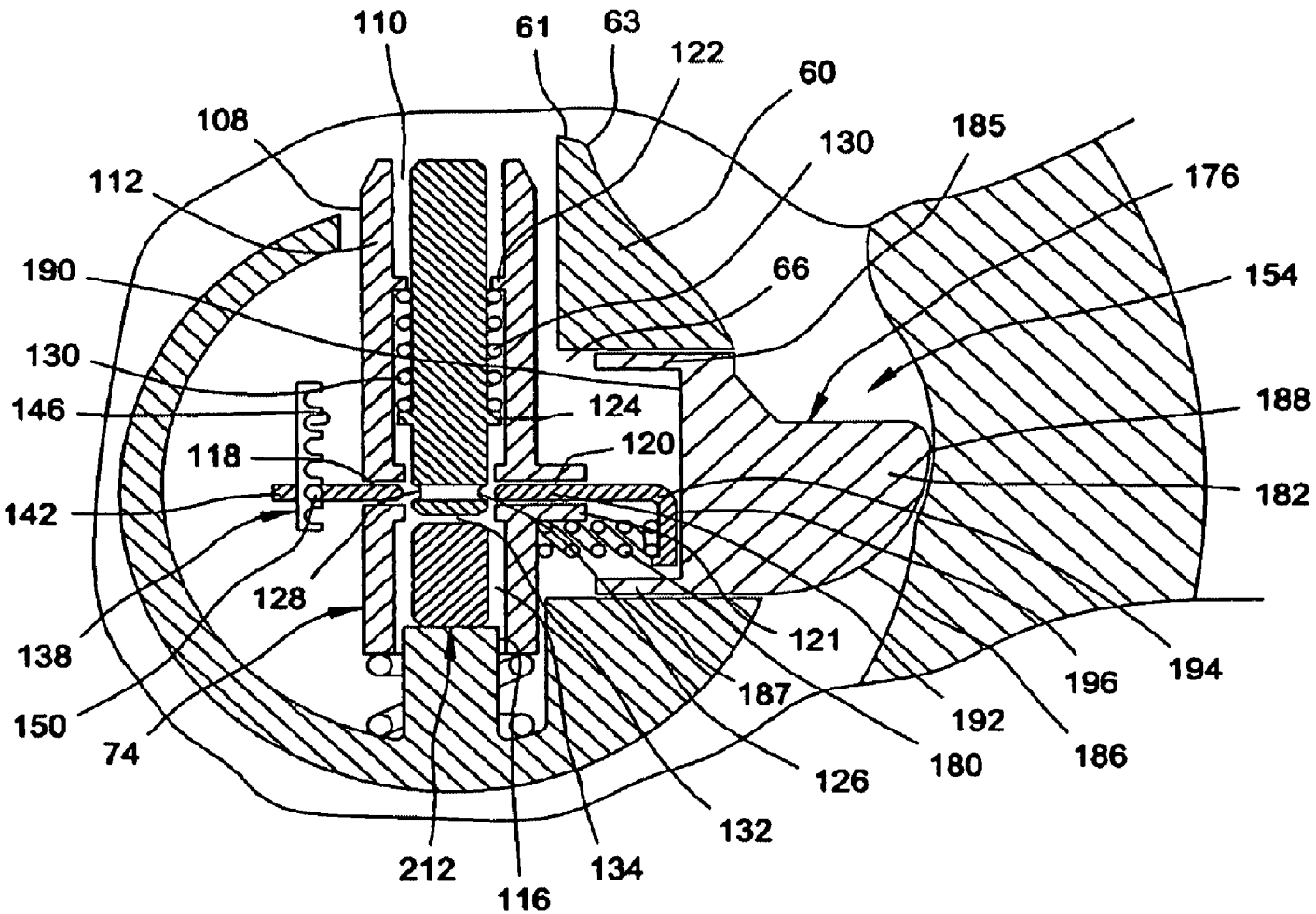
FIG. 5 is a more detailed cross-sectional view of particular components of FIG. 3.

The lower shear cylinder 74 is substantially similar to the upper shear cylinder 72 and is coaxially aligned therewith. The lower shear cylinder 74 includes an outer diameter having a generally cylindrical shape and an arcuate surface 108. The lower shear cylinder 74 further includes a bore 110 and a wall 112 extending the length of the lower shear cylinder 74. The bore 110 extends from an upper open end 114 to a lower open end 116, whereby the upper open end 114 is disposed proximate the recess 56 and the lower open end 116 is disposed proximate the spring seat 62, as best shown in FIG. 3. The wall 112 includes a lock bore 118 for interaction with the lock assembly 18 and an actuation bore 120 for interaction with the actuation assembly 20. The actuation bore 120 further includes a support collar 121 integrally formed with the lower shear cylinder 74 to reinforce the junction between the actuation bore 120 and the wall 112. In addition, the wall 112 includes an annular tab 122 formed on an inner surface of the wall 112 disposed between the upper and lower open ends 114, 116, generally proximate the lock and actuation bores 118, 120, as best shown in FIG. 5.

The lower pin 78 is slidably received by the bore 110 of the lower shear cylinder 74 and includes an annular shoulder 124, an annular groove 126, and an engagement bore 128 formed through the lower pin 78. The engagement bore 128 is operable to align with both the lock bore 118 and the actuation bore 120, as will be discussed further below. In addition, a pin spring 130 annularly surrounds the lower pin 78 to bias the lower pin 78 in a direction generally away from the recess 56 and toward the lower open end 116. The pin spring 130 engages the annular tab 122 at a first end and engages the annular shoulder 124 of the lower pin 78 at a second end. In this manner, the pin spring 130 is operable to bias the lower pin 78 relative to the lower shear cylinder 74, generally toward the lower open end 116. In addition, the lower pin 78 includes an engagement surface 132 formed proximate the annular shoulder 124, as best shown in FIG. 3. The engagement surface 132 opposes the spring seat 62 such that a key recess 134 is formed therebetween.

As previously discussed, the lower shear cylinder 74 is co-axially aligned with the upper shear cylinder 72. In this manner, the bore 84 of the upper shear cylinder 72 is aligned with the bore 110 of the lower shear cylinder 74 and defines a first shear zone 141 between the open end 94 of the upper shear cylinder 72 and the upper open end 114 of the lower shear cylinder 74. Additionally, a second shear zone 143 is defined between the upper pin 76 and lower pin 78, whereby the second shear zone 143 is operable to move relative to the upper and lower shear cylinders 72, 74, as will be discussed further below.

The lock assembly 18 is operable to fixedly hold the upper and lower shear cylinders 72, 74 relative to the outer and inner cylinders 12, 14. The lock assembly 18 includes an upper lock rack 136, a lower lock rack 138, an upper lock pin 140, and a lower lock pin 142. The upper lock rack 136 is fixed to the outer cylinder 12 and includes a plurality of locking recesses 144 while the lower lock rack 138 similarly includes a plurality of locking recesses 146 and is fixedly attached to the inner cylinder 14.

The upper lock pin 140 is an elongate cylindrical member and is operable to be slidably received by the lock bore 96, formed in the upper shear cylinder 72. In addition, the upper lock pin 140 includes a lock post 148 integrally formed therewith for interaction with the upper lock rack 136. Specifically, the lock post 148 is formed generally perpendicular to the upper lock pin 140 and is operable to matingly engage the locking recesses 144 formed in the upper lock rack 136 as the lock pin 140 translates within the lock bore 96.

The lower lock pin 142 is an elongate cylindrical member and is operable to be slidably received by the lock bore 118, formed in the lower shear cylinder 74. In addition, the lower lock pin 142 includes a lock post 150 integrally formed therewith for interaction with the lower lock rack 138. Specifically, the lock post 150 is formed generally perpendicular to the lower lock pin 142 and is operable to mabngly engage the locking recesses 146 formed in the lower lock rack 138 as the lock pin 142 translates within the lock bore 118.

The actuation assembly 20 is operable to fix the upper and lower pins 76, 78 relative to the upper and lower shear cylinders 72, 74, respectively, when the inner cylinder 14 is rotated relative to the outer cylinder 12. Specifically, the actuation assembly 20 includes an upper assembly 152 operable to selectively fix the upper pin 76 to the upper shear cylinder 72 and a lower assembly 154 operable to selectively fix the lower pin 78 relative to the lower shear cylinder 74.

The upper assembly 152 includes a cam 156, an upper actuation pin 158, and an upper spring 160, as best shown in FIG. 4. The cam 156 is rotatably supported by the outer cylinder 12 and includes a main body 162 and a flange 164 extending from the main body 162. The main body 162 includes an outer surface 166 having a pin engagement surface 168 operable to translate the actuation pin 158 in response to movement of the inner cylinder 14. The flange 164 extends from the main body 162 and includes a cylinder engagement surface 170 operable to engage the inner cylinder 14 when the inner cylinder 14 rotates relative to the outer cylinder 12.

The upper actuation pin 158 includes a generally L-shape having a first leg 172 slidably received by the actuation bore 98 of the upper shear cylinder 72 and a second leg 174 formed generally perpendicular to the first leg 172. The second leg 174 includes a reaction surface 176, whereby the reaction surface 176 abuts the pin engagement surface 168 of the cam 156, as best shown in FIG. 5. The overall length of the reaction surface 176 is governed by the overall length of the upper lock rack 136 to ensure that the reaction surface 176 maintains constant engagement with the pin engagement surface 168 of the cam 156 as the upper shear cylinder 72 is moved relative to the upper lock rack 136 through the plurality of locking recesses 144.

The upper spring 160 is disposed between the upper shear cylinder 72 and the second leg 174 of the actuation pin 158, as best shown in FIGS. 3 and 4. The spring 160 biases the actuation pin 158 toward the cam 156, and out of engagement with the upper pin 76. In this manner, a sufficient force must be applied to the second leg 174 of the actuation pin 158 to over come the bias of the upper spring 160 for the first leg 172 of the actuation pin 158 to translate within the actuation bore 98 of the upper shear cylinder 72 and engage the upper pin 76.

The lower assembly 154 includes a cam 176, a lower actuation pin 178, and a lower spring 180, as best shown in FIG. 5. The cam 176 is slidably supported by the inner cylinder 14 and includes a main body 182 and a recess 184. The main body 182 includes an outer surface 186 having a cam surface 188 operable to engage the inner surface 36 of the outer cylinder 12 to translate the actuation pin 178 in response to rotation of the inner cylinder 14 relative to the outer cylinder 12. The recess 184 is formed between upper and lower flanges 185, 187 of the main body 182 and includes an engagement surface 190 operable to engage the lower actuation pin 178.

The lower actuation pin 178 includes a generally L-shape having a first leg 192 slidably received by the actuation bore 120 of the lower shear cylinder 74 and a second leg 194 formed generally perpendicular to the first leg 192, as best shown in FIG. 5. The second leg 194 includes a reaction surface 196, which abuts the pin engagement surface 190 of the recess 184. The length of the recess 184, generally defined between the upper and lower flanges 185, 187, is governed by the overall length of the lower lock rack 138. Specifically, the length of the recess 184 is designed to ensure that the reaction surface 196 maintains constant engagement with the engagement surface 190 of the cam 176 as the lower shear cylinder 74 is moved relative to the lower lock rack 138 through the various locking recesses 146 disposed on the lower lock rack 138.

The lower spring 180 is disposed between the lower shear cylinder 74 and the second leg 194 of the actuation pin 178, as best shown in FIGS. 3 and 5. The spring 180 biases the actuation pin 178 toward the cam 176 and out of engagement with the lower pin 78. In this manner, a sufficient force must be applied to the second leg 194 of the actuation pin 178 to over come the bias of the lower spring 180 for the first leg 192 of the actuation pin 178 to translate within the actuation bore 120 of the lower shear cylinder 74 and engage the lower pin 78.

Figure 10:
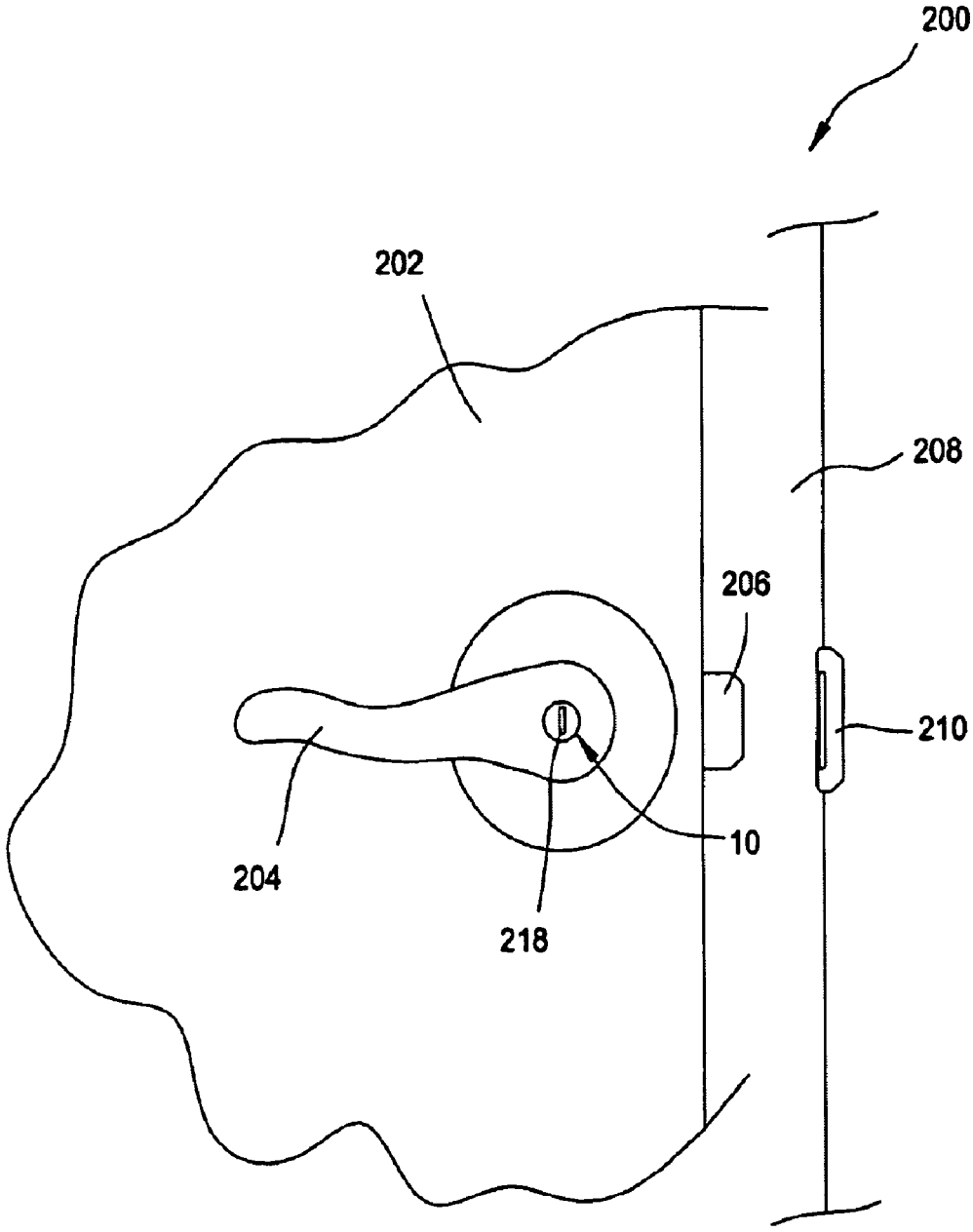
FIG. 10 is a sectional view of the lock cylinder of FIGS. 1 and 2 in a door handle assembly.

With reference to the figures, the operation of the lock cylinder 10 will be described in detail. The lock cylinder 10 is shown incorporated into a door assembly 200 having a door 202, a handle 204, and a latch bolt 206, as shown in FIG. 10. The lock cylinder 10 is operable to permit or restrict rotation of the handle 204 relative to the door 202 to selectively lock the door 202 relative to a doorframe 208. Specifically, as the door handle 204 is permitted to rotate, the latch bolt 206 may be selectively retracted from engagement with a latch plate 210 disposed on the doorframe 208. As can be appreciated, as the latch bolt 206 is retracted from engagement with the latch plate 210, the door 202 is permitted to rotate relative to the door frame 208 and when the latch bolt 206 is extended, and engaged with the latch plate 208, the door is restricted from rotating relative to the door frame 208. In this regard, the lock cylinder 10 is operable to selectively permit or restrict rotation of the door 202 relative to the doorframe 208 by selectively permitting and restricting rotation of the door handle 204.

Figure 6:
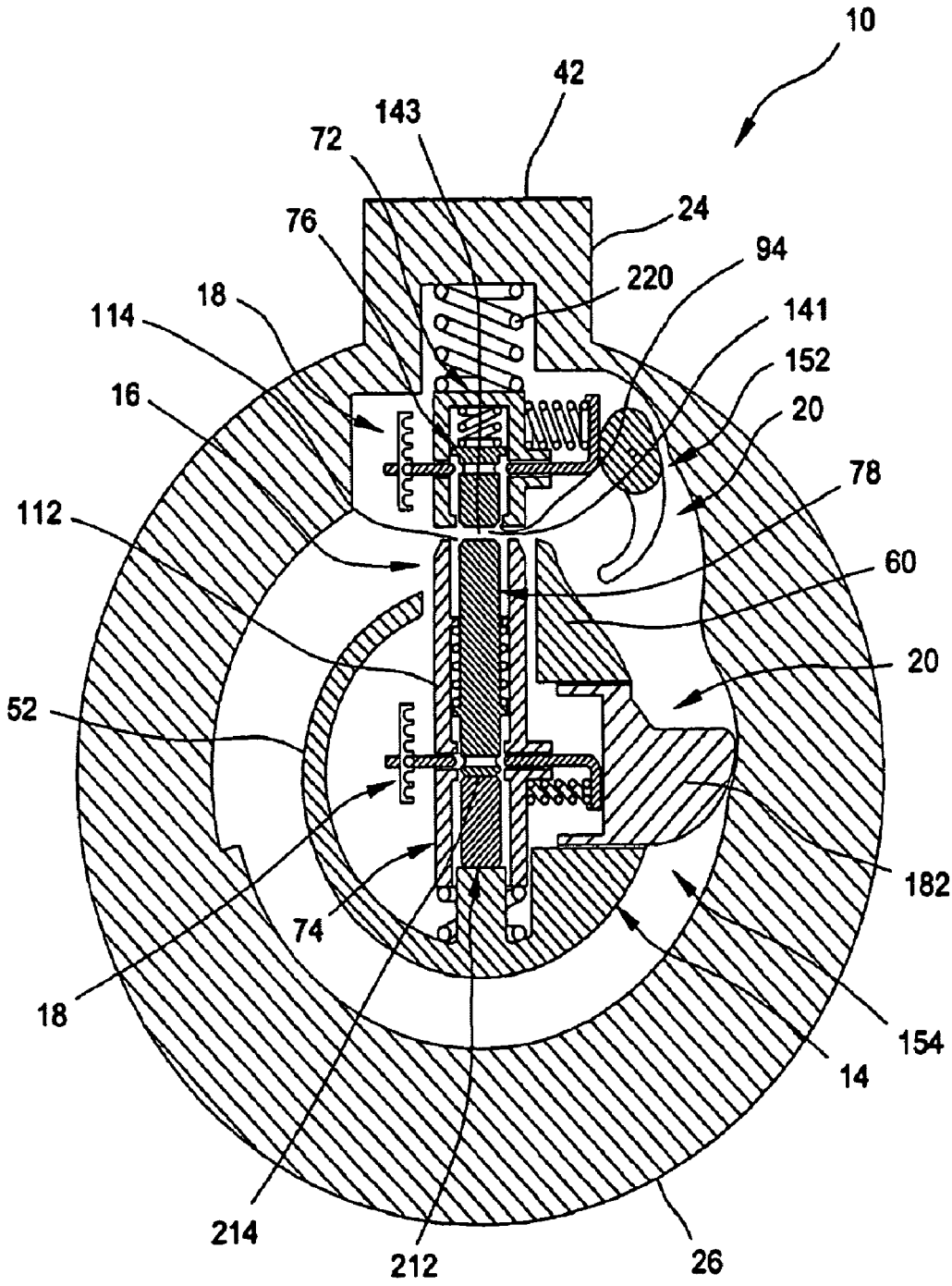
FIG. 6 is a sectional view of the lock cylinder of FIGS. 1 and 2 in an unlocked position.

To selectively lock and unlock the lock cylinder 10, a key 212 is provided and includes a plurality of raised engagement surfaces 214 and a flat or planar surface 216 formed on an opposite side of the key 212 from the raised surfaces 214. To unlock the lock cylinder 10, and permit rotation of the door handle 204, the key 212 is inserted into a key hole 218 formed in the first end 28 of the inner cylinder 14. In this manner, the key 212 is received by the key recess 134 of the lower shear cylinder 74 and contacts the engagement surface 132 of the lower pin 78, as best shown in FIG. 6. Specifically, each raised surface 214 of the key 212 contacts a respective engagement surface 132 of a respective pin assembly 16 while the planar surface 216 contacts the reaction surface 70 of the spring seat 62, as best shown in FIG. 2.

Provided the correct key 212 is inserted into the key recess 134, each raised surface 214 is operable to engage each lower pin 78 to thereby raise the lower pin 78 relative to the lower shear cylinder 74 and raise the upper pin 76 relative to the upper shear cylinder 72. Once the upper and lower pins 76, 78 are sufficiently raised relative to the upper and lower shear cylinders 72, 74, the second shear zone 143 will clear the upper open end 114 of the lower shear cylinder 74 and align with the first shear zone 141 to permit rotation of the inner cylinder 14 relative to the outer cylinder 12. As can be appreciated, each of the raised surfaces 214 are of varying height and will thus raise each independent lower pin 78 a different amount relative to the lower shear cylinder 74.

Figure 7:
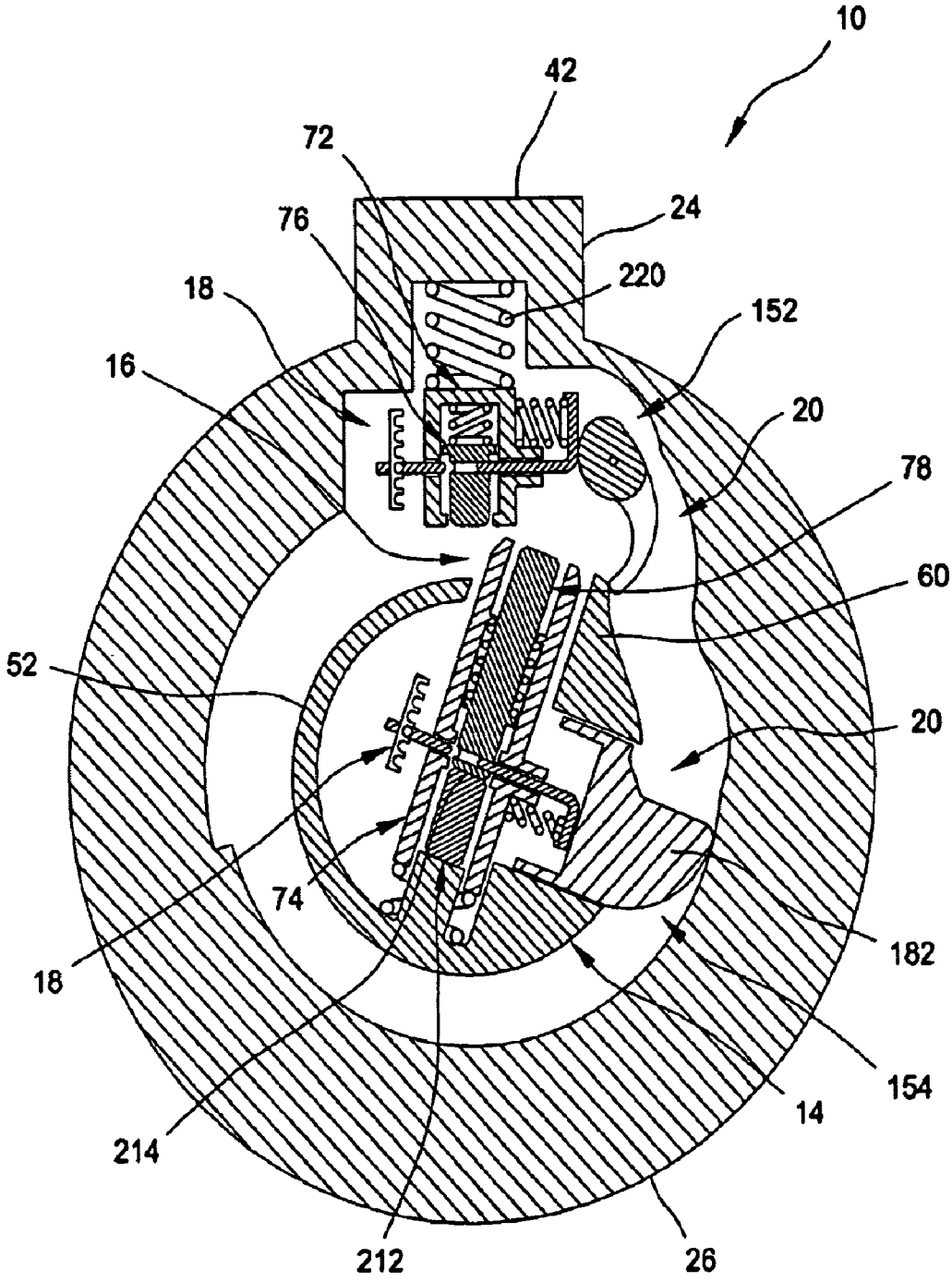
FIG. 7 is a sectional view of the lock cylinder of FIGS. 1 and 2 in a locked position showing an inner cylinder rotating relative an outer cylinder.

Once the correct key 212 is fully inserted into the key recess 134, the inner cylinder 14 is permitted to rotate relative to the outer cylinder 12, as best shown in FIG. 7. To rotate the inner cylinder 14, an external force is applied to the inner cylinder 14 via the key 212. Upon receiving a sufficient force, the inner cylinder 14 will rotate relative to the outer cylinder 12, thereby causing the flange 164 of the cam 156 to engage the shoulder 60 of the inner cylinder 14. Engagement between the flange 164 and the shoulder 60 of the inner cylinder 14 causes the cam 156 to rotate, thereby causing the pin engagement surface 168 to contact the second leg 174 of the actuation pin 158 and compress the upper spring 160.

Once the upper spring 160 is sufficiently compressed, the first leg 172 of the actuation pin 158 will translate within the actuation bore 98 of the upper shear cylinder 72 and engage the engagement bore 106 of the upper pin 76. In this regard, the upper pin 76 is locked in a fixed position relative to the upper shear cylinder 72 to prevent the upper spring 80 from biasing the upper pin 76 out of engagement with the upper shear cylinder 72. As can be appreciated, without the lower pin 78 to hold the upper pin 76 within the upper shear cylinder 72, the upper spring 80 would cause the upper pin 76 to be released from the upper shear cylinder 72 at the open end 94.

Similarly, upon sufficient rotation of the inner cylinder 14, the cam 176 of the lower actuation assembly 154 will engage the inner surface 36 of the outer cylinder 12, thereby causing the cam 176 to translate on the shelf portion 64. Sufficient translation of the cam 176 will cause the second leg 194 of the lower actuation pin 178 to engage the engagement surface 190 of the recess 184 and cause the pin 178 to move against the bias of the lower spring 180. Once the pin 178 sufficiently compresses the spring 180, the pin 178 will translate within the actuation bore 120 of the lower shear cylinder 74 and engage the engagement bore 128 of the lower pin 78, thereby locking the lower pin 78 relative to the lower shear cylinder 74. In this regard, the lower pin 78 is locked in a fixed position relative to the lower shear cylinder 74 to prevent the pin spring 130 from biasing the lower pin 78 out of engagement with the lower shear cylinder 74. As can be appreciated, without the lower pin 142 to hold the lower pin 78 within the lower shear cylinder 74, the pin spring 130 would cause the lower pin 78 to be released from the lower shear cylinder 74 at the upper open end 114.

In the event that the incorrect key is inserted into the key recess 134, the raised portions of the key will not properly align first shear zone 141 with the second shear zone 143, and will thereby not unlock the lock cylinder 10. Specifically, as the raised portions of the key contact the lower pins 78, the upper and lower pins 76, 78 will be raised relative to the upper and lower shear cylinders 72, 74, but will not be raised to a point at which the first shear zone 141 aligns with the second shear zone 143 to permit rotation of the inner cylinder 14 relative to the outer cylinder 12.

If the incorrect key is inserted into the key recess 134, the second shear zone 143 will either be disposed below the first shear zone 141 as shown in FIG. 3, or will be pushed into a region within the upper shear cylinder 72, generally above the first shear zone 141. In either event, the inner cylinder 14 will not be permitted to rotate relative to the outer shear cylinder 12 as the first and second shear zones 141, 143 are not properly aligned. As can be appreciated, if the first and second shear zones 141, 143 are not properly aligned, the upper and lower pins 76, 78 will interfere with the upper and lower shear cylinders 72, 74, thereby prohibiting rotation of the inner cylinder 14 relative to the outer cylinder 12.

As the first shear zone 141 must be properly aligned with the second shear zone 143 to permit rotation of the inner cylinder 14 relative to the outer cylinder 12, it is also important to position the first shear zone 141 such that the first shear zone 141 is disposed within the recess 56 between the inner and outer cylinders 14, 12 to prevent interference between the upper and lower shear cylinders 72, 74 and the inner surface 36 of the outer cylinder 12. To ensure that the first shear zone 141 is disposed within the recess 56, the lock assembly 18 serves to fix the upper and lower shear cylinders 72, 74 relative to the inner and outer cylinders 14, 12 such that the first shear zone 141 is disposed within the recess 56.

Figure 8:
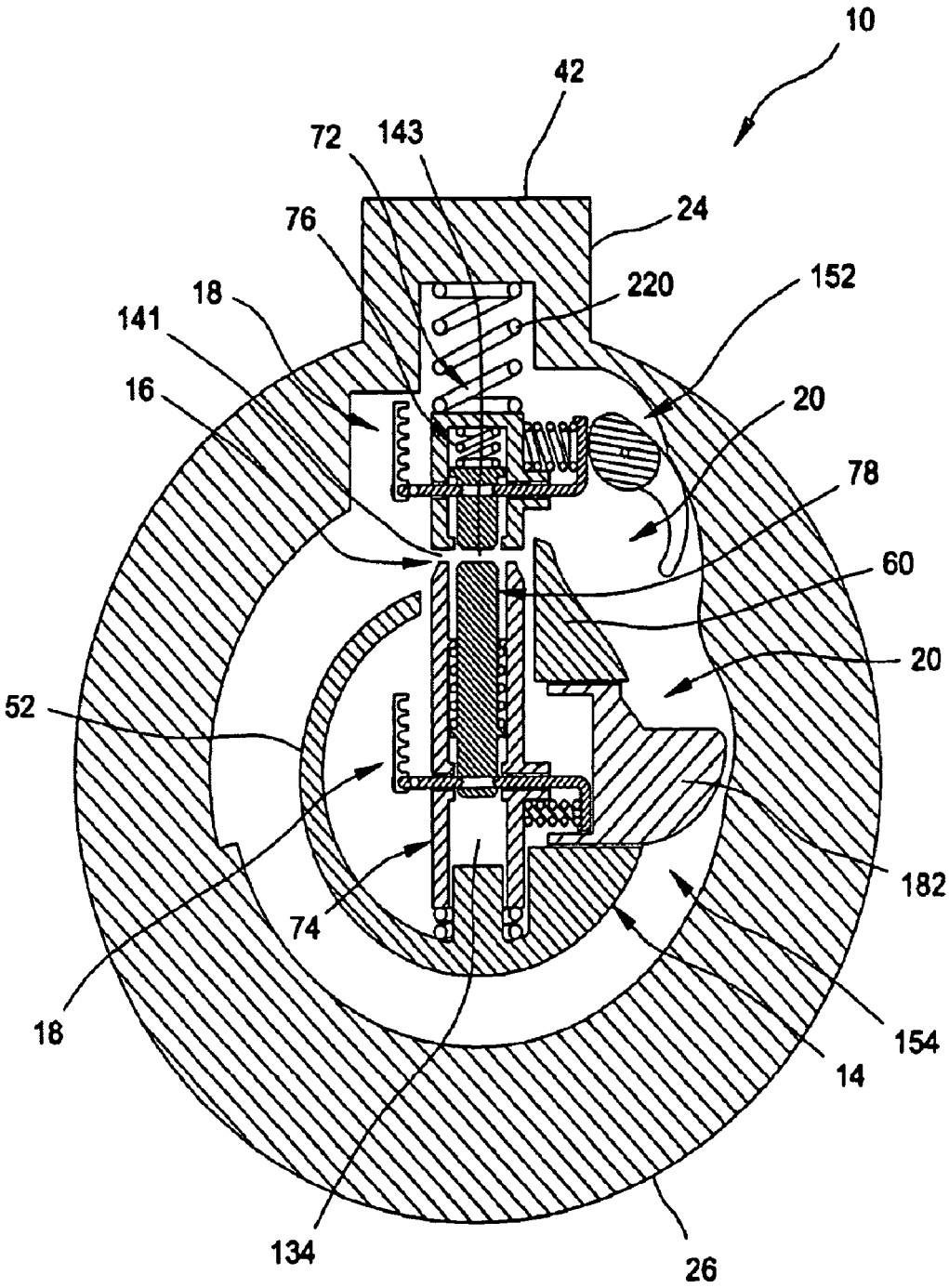
FIG. 8 is a sectional view of the lock cylinder of FIGS. 1 and 2 in a learn mode showing an upper shear cylinder in a reset position and a lower shear cylinder in a reset position.

The upper and lower shear cylinders 72, 74 are fixed relative to the outer and inner cylinders 12, 14 through a reset or re-keying operation. To re-key the lock cylinder 10, the correct key 212 is inserted into the key recess 134 to properly align the first and second shear zones 141, 143 and position the lock cylinder 10 in the unlocked condition. Once the first and second shear zones 141, 143 are properly aligned, the upper lock pin 140 is disengaged from the upper lock rack 136 using a pin tool (not shown) and the lower lock pin 142 is disengaged from the lower lock rack 138 using a pin tool (not shown), as best shown in FIG. 8. The pin tools engage the respective upper and lower lock pins 140, 142 to selectively move the pins 140, 142 into, and out of, engagement with the upper and lower lock racks 136, 138. As the upper lock pin 140 disengages the upper lock rack 136, the upper lock pin 140 translates within the upper lock bore 96 of the upper shear cylinder 72 and engages the engagement bore 106 of the upper pin 76. In addition, as the lower lock pin 142 disengages the lower lock rack 138, the lower lock pin 142 translates within the lower lock bore 118 of the lower shear cylinder 74. In this manner, the upper and lower pins 76, 78 are fixed for movement with the upper and lower shear cylinders 72, 74 and the first and second shear zones 141, 143 are fixed in alignment relative to one another.

Once the upper and lower pins 76, 78 are fixed to the upper and lower shear cylinders 72, 74, respectively, and the lock pins 140, 142 are disengaged from the lock racks 136, 138, the key 212 may be removed. Removal of the key 212 will cause the pin assembly 16 to be biased into a reset position by a spring 220 acting on the top surface of the upper shear cylinder 72, as best shown in FIG. 8. In this condition, the lock cylinder 10 is in a learn or reset mode, having the lower shear cylinder 74 positioned such that the engagement surface 132 of the lower pin 78 is proximate the spring seat 62.

Figure 9:
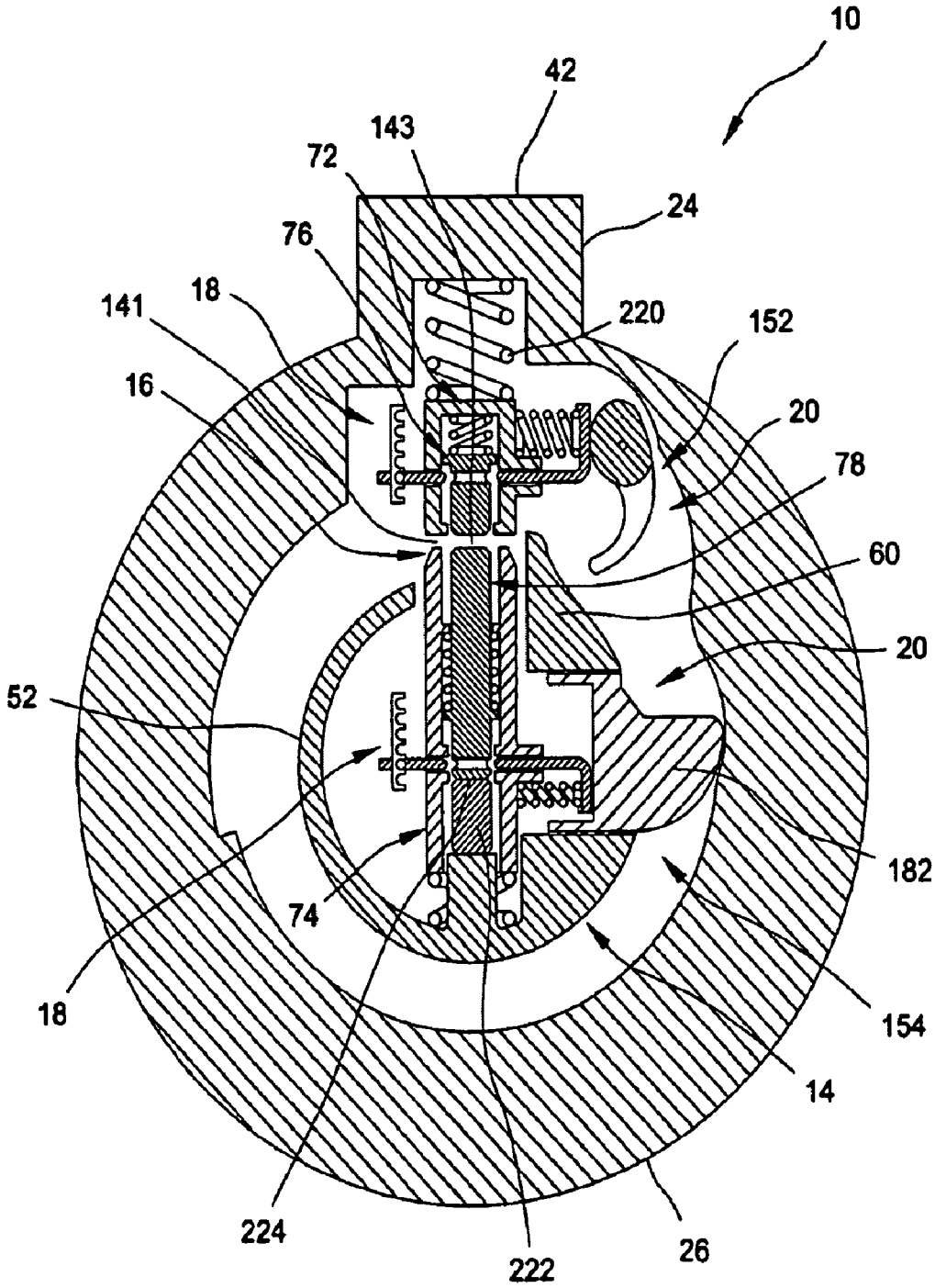
FIG. 9 is a sectional view of the lock cylinder of FIGS. 1 and 2 in a learn mode showing a new key re-positioning an upper shear cylinder and lower shear cylinder relative an outer and inner cylinder.

Once the pin assembly 16 is in the reset or learn mode, a new key 222 may be inserted into the key recess 134 of the lower shear cylinder 74. As the new key 222 is inserted, the raised portions 224 of the key 222 will caused the lower pins 78 of the respective pin assemblies 16 to raise both the lower shear cylinder 74 and lower pin 78 as well as the upper shear cylinder 72 and upper pin 76 relative to the outer and inner cylinders 12, 14, as best shown in FIG. 9. As the upper pin 76 is locked relative to the upper shear cylinder 72 and the lower pin 78 is locked relative to the lower shear cylinder 74, the aligned first and second shear zones 141, 143 will also be concurrently raised and re-positioned within recess 56 between the outer and inner cylinders 12, 14.

The position of each shear zone 141, 143 relative to the outer and inner cylinders 12, 14 is determined by the overall height of the particular raised surface 224 of the new key 222 acting on the respective lower pin 78. As can be appreciated, taller raised portions of the new key 222 will position the shear zones 141, 143 generally closer to the inner surface 36 of the outer cylinder 12 while shorter raised portions of the new key 222 will position the shear zones 141, 143 closer to the outer surface 52 of the inner cylinder 14.

Once the new key 222 is inserted into the key recess 134, the lock pins 140, 142 are disengaged from the upper and lower pins 76, 78 and re-engage with the respective upper and lower lock racks 136, 138 to fixedly position the upper shear cylinder 73 relative to the outer cylinder 12 and fixedly position the lower shear cylinder 74 relative to the inner cylinder 14. Once the upper lock pin 140 is received by a locking recess 144 of the upper lock rack 136 and the lower lock pin 142 is received by a locking recess 146 of the lower lock rack 138, the new key 222 may be removed. At this point, the new key 222 will be operable to lock and unlock the lock cylinder 10 while the old key 212 will no longer function to do so.

As each raised portion 224 of the new key 222 includes a different height than the next, the shear lines 141, 143 will be positioned within the recess 56 in varying positions such that an overall shear line of the lock cylinder 10 will vary between each pin assembly 16. Such variation between pin assemblies 16 provides the lock cylinder 10 with the capability of being re-keyed without having to replace each individual upper and lower pin 76, 78. In addition, this relationship allows each of the upper pins 76 to be of the same size and allows each of the lower pins 78 to also be of the same size, thereby obviating the need for a plurality of different pins to re-key the lock cylinder 10.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A lock cylinder comprising:

an outer cylinder having a first bore formed along a first longitudinal axis;

an inner cylinder rotatably disposed within said first bore;

a pin assembly disposed within said inner and outer cylinders, said pin assembly operable to selectively lock said inner cylinder relative to said outer cylinder, said pin assembly comprising:

an upper shear cylinder positionable relative to said outer cylinder;

a lower shear cylinder positionable relative to said inner cylinder, said upper and lower shear cylinders movable to define a first shear line therebetween;

an upper pin slidable within said upper shear cylinder and an upper lock pin disposed to engage the upper pin for selectively locking the upper pin against movement in the upper shear cylinder; and a lower pin slidable within said lower shear cylinder and means for selectively locking the lower pin against movement in the lower shear cylinder.

2. The lock cylinder of claim 1 further comprising an upper lock rack, said upper lock rack operable to lock said upper shear cylinder in a plurality of positions relative to said outer cylinder.

3. The lock cylinder of claim 1 further comprising a lower lock rack, said lower lock rack operable to lock said lower shear cylinder in a plurality of positions relative said inner cylinder.

4. The lock cylinder comprising:

an outer cylinder having a first bore formed along a first longitudinal axis;

an inner cylinder rotatably disposed within said first bore;

a pin assembly disposed within said inner and outer cylinders, said pin assembly operable to selectively lock said inner cylinder relative to said outer cylinder, said pin assembly comprising:

an upper shear cylinder positionable relative to said outer cylinder;

a lower shear cylinder positionable relative to said inner cylinder, said upper and lower shear cylinders movable to define a first shear line therebetween;

an upper pin slidable within said upper shear cylinder; and a lower pin slidable within said lower shear cylinder, said upper and lower pins defining a second shear line therebetween;

wherein the lock cylinder is positionable from a locked position to an unlocked position when said first shear line is aligned with said second shear line, and wherein said pin assembly further comprises an upper lock pin and a lower lock pin, said upper lock pin operable to lock said upper pin to said upper shear cylinder when said first shear line is aligned with said second shear line and said lower lock pin operable to lock said lower pin to said lower shear cylinder when said first shear line is aligned with said second shear line.

5. The lock cylinder of claim 4 wherein said upper pin includes a first bore to matingly receive said upper lock pin and said lower pin includes a second bore to matingly receive said lower lock pin.

6. The lock cylinder of claim 4 wherein said upper lock pin is biased out of engagement with said upper pin by a first biasing member and said lower lock pin is biased out of engagement with said lower pin by a second biasing member.

7. The lock cylinder of claim 6 wherein said first biasing member is a spring and said second biasing member is a spring.

8. The lock cylinder of claim 5 further comprising an upper cam and a lower cam, said upper cam operable to urge said upper lock pin into engagement with said upper pin and said lower cam operable to urge said lower lock pin into engagement with said lower pin.

9. The lock cylinder of claim 8 wherein said upper cam includes an engagement surface, said engagement surface operable to receive said inner cylinder upon rotation of said inner cylinder to rotate said upper cam and urge said upper locking pin into engagement with said upper pin.

10. The lock cylinder of claim 8 wherein said lower cam includes a second engagement surface, said second engagement surface operable to engage said outer cylinder upon rotation of said inner cylinder to translate said lower cam and urge said lower locking pin into engagement with said lower pin.

11. The lock cylinder of claim 1 wherein said upper shear cylinder is biased toward said lower shear cylinder.

12. The lock cylinder of claim 1 wherein said lower shear cylinder is biased toward said upper shear cylinder.

13. The lock cylinder of claim 1 wherein said upper shear cylinder includes a first spring disposed therein and said lower shear cylinder includes a second spring disposed therein, said first spring operable to allow said upper pin to move within, and relative to, said upper shear cylinder and said second spring operable to allow said lower pin to move within, and relative to, said lower shear cylinder.

14. The lock cylinder of claim 1 wherein said lower shear cylinder includes a recess, said recess operable to receive a key.

15. The lock cylinder of claim 1 further comprising a plurality of pin assemblies.

16. A lock cylinder comprising:

an outer cylinder having a first bore formed along a first longitudinal axis;

an inner cylinder rotatably disposed within said first bore;

a shear zone defined between said outer and inner cylinders;

a lock assembly disposed within said inner and outer cylinders, said lock assembly operable to selectively lock said inner cylinder relative to said outer cylinder, said lock assembly comprising:

an upper shear cylinder positionable relative to said outer cylinder;

a lower shear cylinder positionable relative to said inner cylinder, said upper and lower shear cylinders movable to define a first shear line therebetween; and an upper lock rack, said upper lock rack operable to lock said upper shear cylinder in a plurality of positions relative to said outer cylinder; and a lower lock rack, said lower lock rack operable to lock said lower shear cylinder in a plurality of positions relative said inner cylinder;

wherein said upper and lower lock racks lock said upper and lower shear cylinders relative said inner and outer cylinders to maintain said first shear line within said shear zone.

17. The lock cylinder of claim 16 wherein said lock assembly includes an upper pin and a lower pin, said upper pin slidably received within said upper shear cylinder and said lower pin slidably received within said lower shear cylinder.

18. The lock cylinder of claim 17 wherein said upper and lower pins define a second shear line therebetween, said second shear line operable to align with said first shear line to allow said inner cylinder to rotate relative said outer cylinder.

19. The lock cylinder of claim 18 wherein said upper shear cylinder includes an upper holding pin and said lower shear cylinder includes a lower holding pin, said upper holding pin operable to lock said upper pin relative said upper shear cylinder when said first and second shear lines are aligned and said lower holding pin operable to lock said lower pin relative said lower shear cylinder when said first and second shear lines are aligned.

20. The lock cylinder of claim 19 wherein said upper holding pin engages a first cam and said lower holding pin engages a second cam, said first cam operable to translate said upper holding pin into engagement with said upper pin when said first and second shear lines are aligned and said second cam operable to translate said lower holding pin into engagement with said lower pin when said first and second shear lines are aligned.

21. The lock cylinder of claim 19 wherein said upper holding pin is biased out of engagement with said upper pin and said lower holding pin is biased out of engagement with said lower pin.

22. The lock cylinder of claim 20 wherein said first cam includes a flange, said flange operable to engage said inner cylinder when said inner cylinder rotates relative said outer cylinder.

23. The lock cylinder of claim 20 wherein said second cam abuts an inner surface of said outer cylinder, said inner surface operable to translate said second cam upon rotation of said inner cylinder relative said outer cylinder.

24. The lock cylinder of claim 16 wherein said upper shear cylinder is biased by a first biasing member in a first direction, said first biasing member operable to bias said upper and lower shear cylinders in said first direction.

25. The lock cylinder of claim 24 wherein said upper shear cylinder further comprises an upper lock pin and said lower shear cylinder includes a lower lock pin, said upper lock pin operable to lock said upper shear cylinder to said upper lock rack and said lower lock pin operable to lock said lower shear cylinder to said lower lock rack.

26. The lock cylinder of claim 16 further comprising a plurality of lock assemblies.

* * * * *